US011118823B2

(12) United States Patent
Senf, Jr.

(10) Patent No.: US 11,118,823 B2
(45) Date of Patent: Sep. 14, 2021

(54) METHODS OF CONTROL FOR TRANSPORT REFRIGERATION UNITS

(71) Applicant: Carrier Corporation, Palm Beach Gardens, FL (US)

(72) Inventor: Raymond L. Senf, Jr., Central Square, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 216 days.

(21) Appl. No.: 16/334,962

(22) PCT Filed: Sep. 18, 2017

(86) PCT No.: PCT/US2017/051976

§ 371 (c)(1),
(2) Date: Mar. 20, 2019

(87) PCT Pub. No.: WO2018/057446

PCT Pub. Date: Mar. 29, 2018

(65) Prior Publication Data

US 2019/0264966 A1 Aug. 29, 2019

Related U.S. Application Data

(60) Provisional application No. 62/397,972, filed on Sep. 22, 2016.

(51) Int. Cl.

| | |
|---|---|
| ***F25B 49/02*** | (2006.01) |
| ***F25B 41/04*** | (2006.01) |
| ***F25B 41/22*** | (2021.01) |

(52) U.S. Cl.

CPC ..... *F25B 49/02* (2013.01); *F25B 41/22* (2021.01); *F25B 2400/19* (2013.01);
(Continued)

(58) Field of Classification Search

CPC ..... F25B 2400/19; F25B 2600/0251; F25B 2600/15; F25B 2600/2513

See application file for complete search history.

(56) References Cited

U.S. PATENT DOCUMENTS

| | | | | |
|---|---|---|---|---|
| 4,542,783 A | | 9/1985 | Fujimoto et al. | |
| 4,811,897 A | * | 3/1989 | Kobayashi | F24F 3/00 236/49.3 |

(Continued)

FOREIGN PATENT DOCUMENTS

| | | |
|---|---|---|
| CN | 1862130 A | 11/2006 |
| CN | 103398516 A | 11/2013 |

(Continued)

OTHER PUBLICATIONS

International Search Report, International Application No. PCT/US2017/051976, dated Nov. 13, 2017, European Patent Office; International Search Report 6 pages.

(Continued)

*Primary Examiner* — Nelson J Nieves
*Assistant Examiner* — Meraj A Shaikh
(74) *Attorney, Agent, or Firm* — Cantor Colburn LLP

(57) ABSTRACT

Systems and methods of operating a refrigeration system including initiating a compressor shutdown operation (302), recording shutdown conditions (304), calculating one or more restart characteristics based on the recorded shutdown conditions (306), comparing the calculated restart characteristics with one or more compressor restart safety limits (308), when the calculated restart characteristics do not satisfy the restart safety limits, performing a temperature modulation pump down operation (310), and when the calculated restart characteristics satisfy the restart safety limits, completing the compressor shutdown operation (312).

16 Claims, 3 Drawing Sheets

(52) U.S. Cl.
CPC ... *F25B 2600/0251* (2013.01); *F25B 2600/15* (2013.01); *F25B 2600/2513* (2013.01)

(56) References Cited

U.S. PATENT DOCUMENTS

| | | | | |
|---|---|---|---|---|
| 5,024,061 | A | 6/1991 | Pfeil, Jr. et al. | |
| 5,157,933 | A | 10/1992 | Brendel | |
| 6,318,100 | B1 | 11/2001 | Brendel et al. | |
| 6,321,549 | B1 | 11/2001 | Reason et al. | |
| 6,672,097 | B1 * | 1/2004 | Ashley | A23G 9/04 62/340 |
| 8,230,694 | B2 | 7/2012 | Scarcella et al. | |
| 9,134,058 | B2 | 9/2015 | Ikemiya et al. | |
| 9,222,706 | B2 | 12/2015 | Takayama et al. | |
| 9,316,423 | B2 | 4/2016 | Yokohara et al. | |
| 9,395,105 | B2 | 7/2016 | Shimazu et al. | |
| 2008/0053120 | A1 * | 3/2008 | Nakai | F25B 13/00 62/157 |
| 2008/0066483 | A1 * | 3/2008 | Klier | A23G 9/045 62/342 |
| 2008/0307810 | A1 * | 12/2008 | VanderZee | F25B 49/02 62/222 |
| 2010/0000244 | A1 * | 1/2010 | Kawakatsu | F25B 41/062 62/210 |
| 2010/0005819 | A1 | 1/2010 | Kawakatsu et al. | |
| 2012/0192579 | A1 | 8/2012 | Huff et al. | |
| 2012/0247138 | A1 | 10/2012 | Senf, Jr. et al. | |
| 2013/0205812 | A1 | 8/2013 | Yamashita | |
| 2014/0041401 | A1 * | 2/2014 | Douglas | F25B 43/00 62/89 |
| 2017/0108247 | A1 * | 4/2017 | Sata | F25B 49/022 |
| 2018/0051704 | A1 * | 2/2018 | Kihara | F25B 31/004 |

FOREIGN PATENT DOCUMENTS

| | | | |
|---|---|---|---|
| CN | 104696215 | A | 6/2015 |
| CN | 105605836 | A | 5/2016 |
| DE | 102013010672 | A1 | 12/2014 |
| EP | 0692687 | A2 | 1/1996 |
| JP | H05052720 | A | 3/1993 |
| JP | 3026428 | B2 | 3/2000 |
| JP | 2006090891 | A | 4/2006 |
| JP | 2009222272 | A | 10/2009 |
| WO | 2016130537 | A1 | 8/2016 |

OTHER PUBLICATIONS

International Written Opinion, International Application No. PCT/US2017/051976, dated Nov. 13, 2017, European Patent Office; International Written Opinion 8 pages.

Middle TN RSES; "Excerpts from the Technical Institute Manual Three"; Refrigeration Service Engineers Society: Apr. 2012; Accessed on: Mar. 15, 2019; url: http://www.midtennrses.net/2012/04/; 10 pages.

* cited by examiner

METHODS OF CONTROL FOR TRANSPORT REFRIGERATION UNITS

CROSS REFERENCE TO RELATED APPLICATIONS

This is a U.S. National Stage of Application No. PCT/US2017/051976, filed on Sep. 18, 2017, which claims the benefit of U.S. Provisional Patent Application No. 62/397,972, filed on Sep. 22, 2016, the disclosures of which are incorporated herein by reference.

BACKGROUND

The subject matter disclosed herein generally relates to transport refrigeration units and, more particularly, to control and operation of refrigeration units and systems using an evaporation pump down cycle for improving the restart conditions to aid in reliability.

In a typical refrigeration system, compressor on-off cycles can be repeated to maintain desired temperatures within a container or other volume when excess compressor capacity exceeds load demand. The use of scroll type compressors has provided various advantages, but the repeated on-off cycles (e.g., shutdown and restart operations) can generate adverse loads and/or effects on the scroll type compressor. Accordingly, it may be advantageous to improve control and operation of scroll type compressors to minimize such adverse effects (e.g., high density restart conditions).

SUMMARY

According to one embodiment, a method of operating a refrigeration system is provided. The method includes initiating a compressor shutdown operation, recording shutdown conditions, calculating one or more restart characteristics based on the recorded shutdown conditions, comparing the calculated restart characteristics with one or more compressor restart safety limits, when the calculated restart characteristics do not satisfy the restart safety limits, performing a temperature modulation pump down operation, and when the calculated restart characteristics satisfy the restart safety limits, completing the compressor shutdown operation.

In addition to one or more of the features described herein, or as an alternative, further embodiments of the method may include that the shutdown conditions include at least one of return air temperature to an evaporator of the refrigeration system, supply air temperature to a volume cooled by the refrigeration system, or ambient air temperature.

In addition to one or more of the features described herein, or as an alternative, further embodiments of the method may include that the one or more calculated restart characteristics comprises at least one of a static pressure ratio or a predicted static saturated evaporator/suction temperature.

In addition to one or more of the features described herein, or as an alternative, further embodiments of the method may include that the static pressure ratio is a function of ambient air temperature and return air temperature to an evaporator of the refrigeration system.

In addition to one or more of the features described herein, or as an alternative, further embodiments of the method may include that the predicted static saturated evaporator/suction temperature is based on a return air temperature at an evaporator of the refrigeration system.

In addition to one or more of the features described herein, or as an alternative, further embodiments of the method may include that the one or more calculated restart characteristics is a calculated static pressure ratio.

In addition to one or more of the features described herein, or as an alternative, further embodiments of the method may include that the restart safety limit is a predetermined static pressure ratio limit and the comparison comprises determining if the calculated static pressure ratio is less than the predetermined static pressure ratio limit.

In addition to one or more of the features described herein, or as an alternative, further embodiments of the method may include that the one or more calculated restart characteristics is a predicted static saturated evaporator/suction temperature.

In addition to one or more of the features described herein, or as an alternative, further embodiments of the method may include that the restart safety limit is a predetermined static saturated evaporator/suction temperature limit and the comparison comprises determining if the predicted static saturated evaporator/suction temperature is less than the predetermined static saturated evaporator/suction temperature limit.

In addition to one or more of the features described herein, or as an alternative, further embodiments of the method may include that the temperature modulation operation comprises at least one of (i) closing an evaporator control valve, (ii) running a compressor of the refrigeration system in an energized state, (iii) performing a pump down operation, or (iv) performing a suction operation.

In addition to one or more of the features described herein, or as an alternative, further embodiments of the method may include repeating the recording, calculating, and comparing after performing the temperature modulation operation.

In accordance with another embodiment, a refrigeration system is provided. The system includes a compressor, an evaporator, a fluid path fluidly connecting the compressor and the evaporator, an evaporator control valve operably connected to the fluid path to control fluid flow to or form the evaporator, and a controller. The controller is configured to initiate a compressor shutdown operation, record shutdown conditions, calculate one or more restart characteristics based on the recorded shutdown conditions, compare the calculated restart characteristics with one or more compressor restart safety limits, when the calculated restart characteristics do not satisfy the restart safety limits, control the refrigeration system to perform a temperature modulation pump down operation, and when the calculated restart characteristics satisfy the restart safety limits, control the compressor to complete the shutdown operation.

In addition to one or more of the features described herein, or as an alternative, further embodiments of the system may include that the shutdown conditions include at least one of return air temperature to an evaporator of the refrigeration system, supply air temperature to a volume cooled by the refrigeration system, or ambient air temperature.

In addition to one or more of the features described herein, or as an alternative, further embodiments of the system may include that the one or more calculated restart characteristics comprises at least one of a static pressure ratio or a predicted static saturated evaporator/suction temperature.

In addition to one or more of the features described herein, or as an alternative, further embodiments of the system may include that the static pressure ratio is a function of ambient air temperature and return air temperature to an evaporator of the refrigeration system.

In addition to one or more of the features described herein, or as an alternative, further embodiments of the system may include that the predicted static saturated evaporator/suction temperature is based on a return air temperature at an evaporator of the refrigeration system.

In addition to one or more of the features described herein, or as an alternative, further embodiments of the system may include that the one or more calculated restart characteristics is a calculated static pressure ratio and wherein the restart safety limit is a predetermined static pressure ratio limit and the comparison comprises determining if the calculated static pressure ratio is less than the predetermined static pressure ratio limit.

In addition to one or more of the features described herein, or as an alternative, further embodiments of the system may include that the one or more calculated restart characteristics is a predicted static saturated evaporator/suction temperature and wherein the restart safety limit is a predetermined static saturated evaporator/suction temperature limit and the comparison comprises determining if the predicted static saturated evaporator/suction temperature is less than the predetermined static saturated evaporator/suction temperature limit.

In addition to one or more of the features described herein, or as an alternative, further embodiments of the system may include that the temperature modulation operation comprises at least one of (i) closing an evaporator control valve, (ii) running a compressor of the refrigeration system in an energized state, (iii) performing a pump down operation, or (iv) performing a suction operation.

In addition to one or more of the features described herein, or as an alternative, further embodiments of the system may include that the compressor is a scroll type compressor.

Technical effects of embodiments of the present disclosure include a refrigeration system having control parameters and operations to minimize stresses and adverse loads from affecting unit life. Further technical effects include a controller for a refrigeration system and operation thereof wherein a pressure regulation is performed during a compressor shutdown operation such that conditions of the system can be optimized for the next restart operation.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
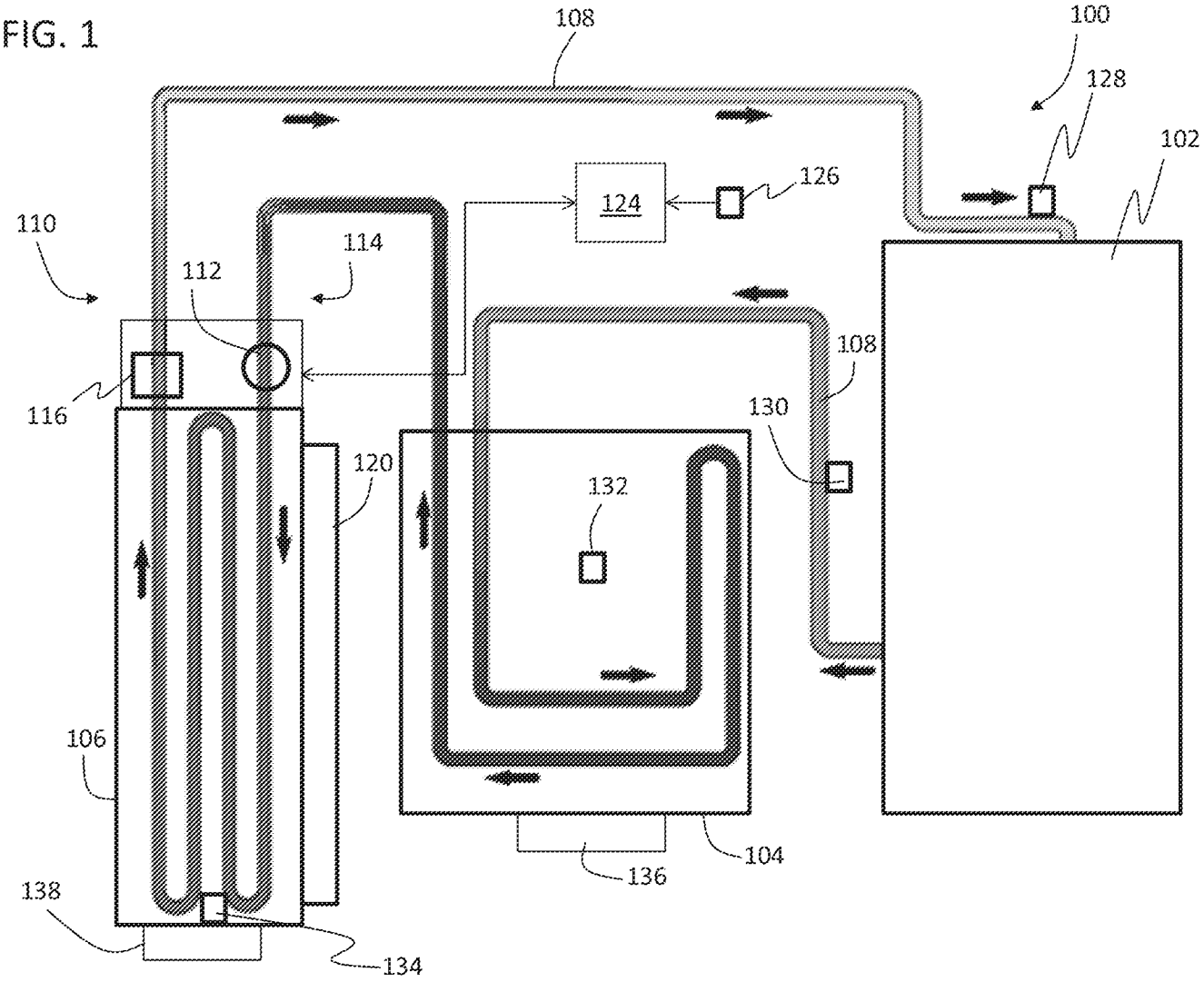
FIG. 1 is a schematic illustration of an refrigeration system in accordance with an example embodiment of the present disclosure.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 is a schematic illustration of a refrigeration system in accordance with an example embodiment. The refrigeration system 100 includes a compressor 102, a condenser 104, and an evaporator 106 that are fluidly connected by a flow path 108. Located between the condenser 104 and the evaporator 106 is an electronic valve assembly 110. Flow of a fluid in the flow path 108, such as a coolant or refrigerant, may be controlled by the electronic valve assembly 110. The condenser 104 and the evaporator 106 may include one or more fans. In some embodiments the fans of the evaporator 106 may be high speed fans.

In some refrigeration system configurations, the compressor 102 may be, for example, a scroll type compressor that may be modulated via digital modulation of the scroll wraps or suction gas modulation of via a suction gas throttling valve. Such scroll type compressors may be subject to stresses or even failure due to high density compressor starts as a result of higher saturated evaporation temperatures. Scroll type compressors may be subject to repeated cycling (on/off) due to excess capacity. When installed with a box container to be cooled by a refrigeration system having a scroll type compressor, variable density restart conditions may exist that are based on the temperature of the box container. As will be appreciated by those of skill in the art, the scroll type compressor can be a scroll type compressor (e.g., fixed scroll, orbital scroll, etc.).

The electronic valve assembly 110 includes a valve 112 at an input side 114 of the evaporator 106 along the flow path 108. The valve 112 meters flow of the fluid to the evaporator 106. The valve 112 can be an electronic expansion valve. The electronic valve assembly 110 can also include one or more sensors as known in the art that are configured to monitor fluid characteristics (e.g., temperature, pressure, etc.). If the fluid is sensed to be below a predetermined temperature, the valve 112 will close to prevent the evaporator 106 from becoming over cooled. In other embodiments, the valve can be configured to prevent flooding of the evaporator 106 and compressor 102 when a low superheat is detected, as known in the art. Alternatively, the valve 106 can open as appropriate (e.g., when the superheat is high). Further, as shown in FIG. 1, an evaporator heater 120 may be thermally connected to the evaporator 106 and configured to prevent overcooling of the evaporator 106.

The electronic valve assembly 110 can be positioned between the condenser 104 and the evaporator 106, i.e., positioned on the input side 114 of the evaporator 106 along the flow path 108. The electronic valve assembly 110 can include one or more valve sensors 116. As known in the art, the electronic expansion valve 112 operates to control a flow of refrigerant entering a direct expansion evaporator (e.g., evaporator 106). The electronic expansion valve 112 is controlled by an electronic controller 124. As known by those of skill in the art, a small motor may be used to open and close a valve port of the electronic expansion valve 112. In some configurations, the motor is a step or stepper motor, which may not rotate continuously. The electronic controller 124 (or dedicated motor electronic controller) can control the motor to rotate a fraction of a revolution for each signal sent to the motor by the electronic controller 124. The step motor is driven by a gear train, which positions a pin in a port in which refrigerant flows, and thus fluid flow can be controlled by operation and control of the electronic expansion valve 112.

The electronic controller 124 can be in communication with one or more sensors 126-134 that are configured to monitor various aspects of the refrigeration system 100. For example, one or more box sensors 126 can be positioned within a volume that is cooled by the refrigeration system 100 and can be configured to monitor box temperature, pressure, etc. A compressor inlet sensor 128 and a compressor outlet sensor 130 can be configured relative to the compressor 102 along the flow path 108. Further, a condenser sensor 132 can be configured within the condenser 104 and an evaporator sensor 134 can be configured within the evaporator 106. The condenser sensor 132 and the evaporator sensor 134 can be configured to monitor air that passes through the respective condenser 104 and evaporator 106. The air can be blown through or pulled through the condenser 104 and the evaporator 106 by respect fans 136, 138. The condenser fan 136 can pull in ambient or returning air, and direct it over the flow path 108 as it passes through the condenser 104. Similarly, the evaporator fan 138 can pull in air, e.g., box air, and direct it over the flow path 108 as it passes through the evaporator 106.

The various sensors 126-134 can be used to monitor various aspects of the refrigeration system 100 and/or a volume that is cooled thereby. As noted above, the sensors 116, 126-134 can be used to provide feedback and monitoring capabilities to the electronic controller 124. As such, the electronic controller 124 can be used to control the refrigeration system 100 in accordance with embodiments described herein.

In some embodiments, the electronic valve assembly 110 can be replaced or substituted with a suction modulation valve, as known in the art. Alternatively, in some embodiments, the refrigeration system 100 can include electronic expansion valve(s), suction modulation valve(s), and/or other valves as known in the art.

Figure 2:
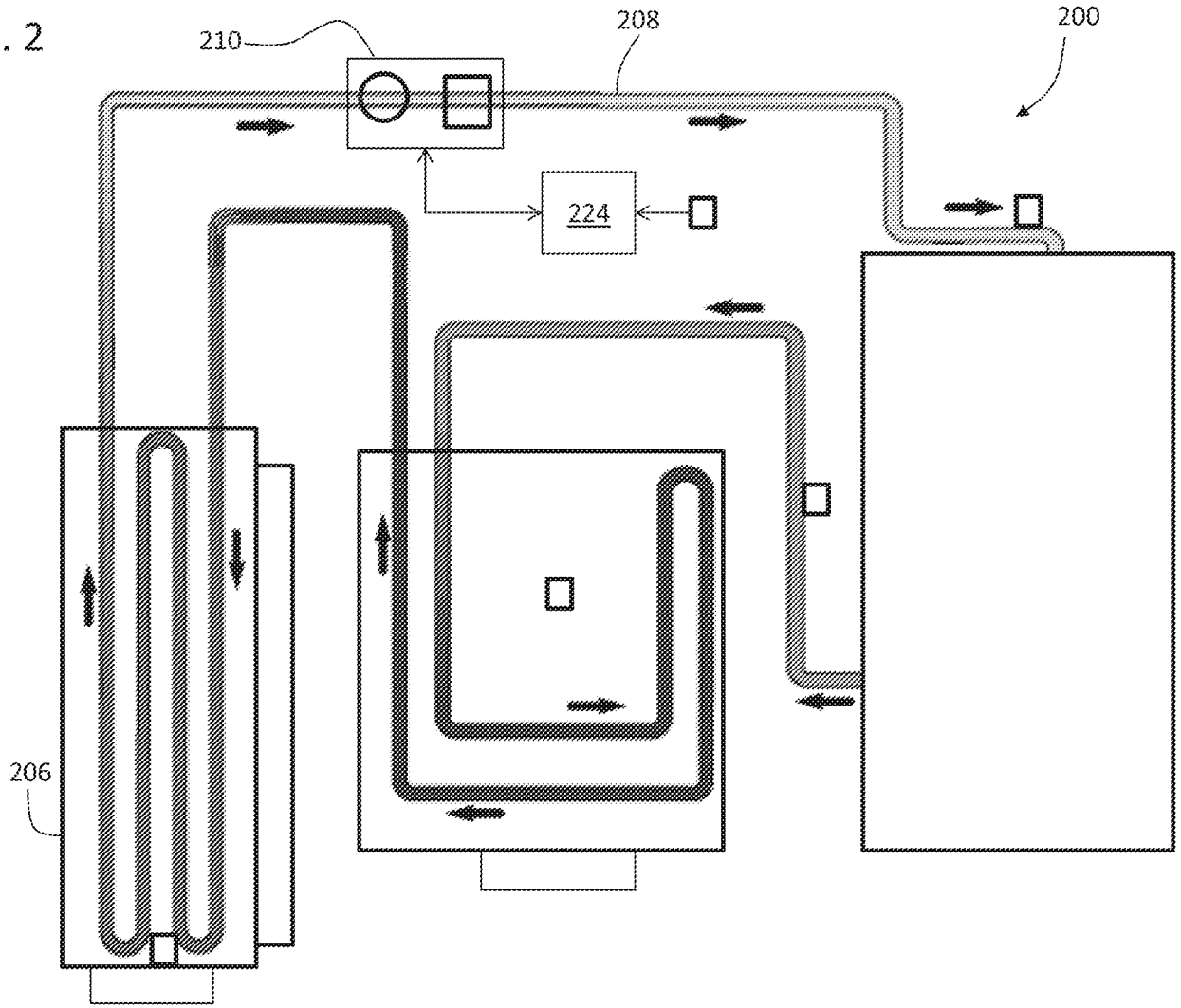
FIG. 2 is a schematic illustration of another refrigeration system in accordance with an example embodiment of the present disclosure.

For example, turning to FIG. 2, a refrigeration system 200 similar to the refrigeration system 100 of FIG. 1 is schematically shown. The refrigeration system 200 includes similar aspects and components, and thus the same or similar features will not be labeled or described again. In the embodiment of FIG. 2, the refrigeration system 200 includes an electronic valve assembly 210 that is a suction modulation valve. The suction modulation valve 210 is operably controlled by an electronic controller 224 and is configured along the flow path 208 downstream from an evaporator 206. The electronic controller 224 can be configured to perform operations as described herein to control the suction modulation valve 210. As will be appreciated by those of skill in the art, such configuration can include additional features and components, such as a thermal expansion valve and/or other components, which are not shown for simplicity.

Those of skill in the art will appreciate that the schematics and configurations shown in FIGS. 1-2 are merely examples of refrigeration units/systems and are not intended to be limiting. For example, other components or configurations are possible with departing from the scope of the present disclosure. For example, refrigeration systems may include controllers, receivers, filters, dryers, additional valves, heat exchangers, sensors, indicators, etc. without departing from the scope of the present disclosure. Further, in some embodiments, a refrigeration system can include features from both FIG. 1 and FIG. 2, such as the electronic valve assembly 110 and the electronic valve assembly 210.

To address the part life of scroll type compressors, embodiments provided herein are directed to shut-off cycles that promote low density restart conditions that provide less stress on scroll type compressors. That is, control systems and operations can be performed in accordance with the present disclosure to establish favorable restart conditions for refrigeration systems that include scroll type compressors. The electronic valve assemblies described above, and as known in the art, can be controlled to perform pump down operations to achieved desired conditions. For example, when using an electronic expansion valve, a pump down operation can be performed to achieve desired conditions in an evaporator, or a suction modulation valve can be sued to pump down the compressor to desired conditions. As such, the electronic valve assembly as used herein can include various types of electronic valves and can be positioned in various locations along a flow path through a refrigeration system, without departing from the scope of the present disclosure.

In accordance with various embodiments of the present disclosure, an electronic valve assembly (e.g., electronic expansion valve, suction modulation valve, etc.) is controlled or otherwise utilized to perform a controlled pump-down at or during a compressor-shutdown operation (e.g., during an off cycle) to alter a refrigerant density to a lower more desirable state for the next compressor restart condition (e.g., during an on cycle). For example, in one non-limiting example, the electronic valve assembly is closed with the compressor running and performing an overcooling prior to shut down. Such closure will pump some of the refrigerant out of the evaporator and lower the density of the refrigerant, for example, to a value typically observed for a 30° F. (−1.11° C.) box set point. With a tight evaporator control valve and compressor, the more desirable low density condition can be maintained during the off cycle for the next compressor restart. Accordingly, unwanted scroll set motion or instability can be minimized.

Figure 3:
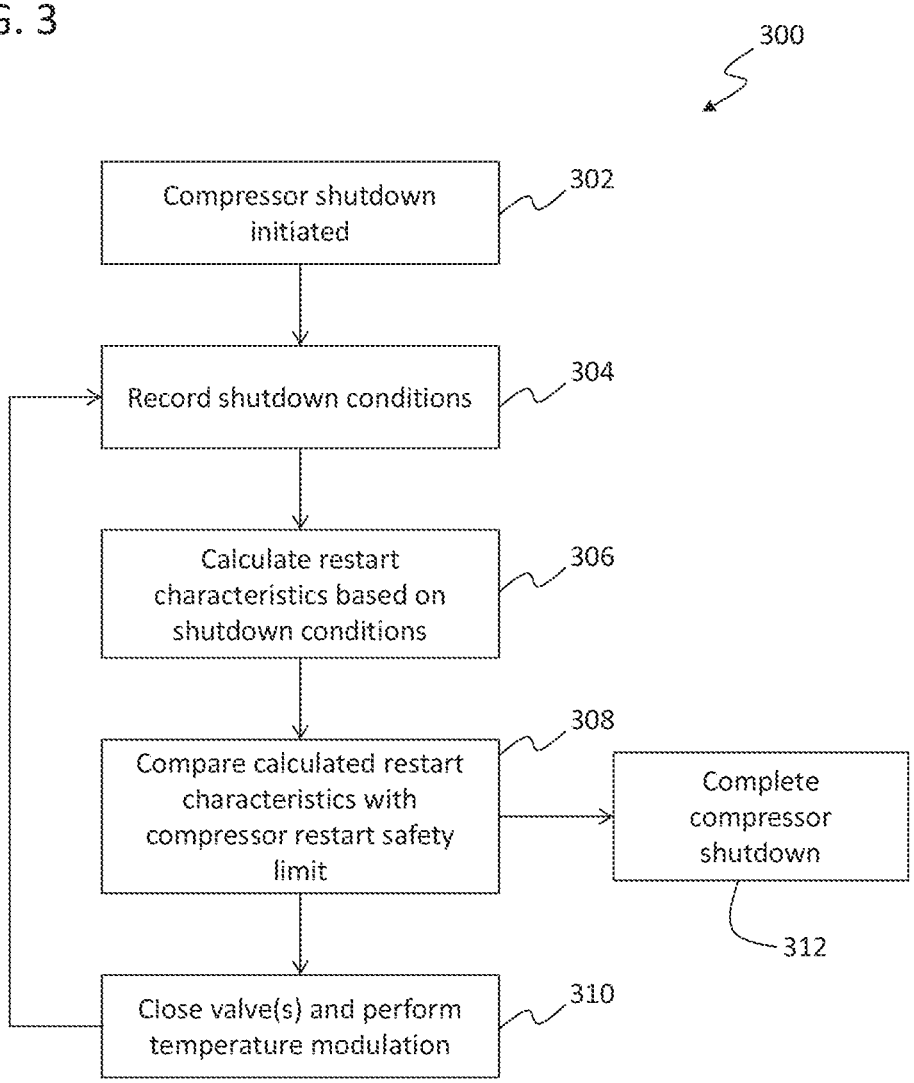
FIG. 3 is a flow process for controlling a refrigeration unit in accordance with a non-limiting embodiment of the present disclosure.

Turning now to FIG. 3, a flow process 300 for controlling a refrigeration system, and in particular an electronic valve assembly, in accordance with a non-limiting embodiment of the present disclosure is shown. The flow process 300 can be performed using one or more refrigeration system controllers. The controller(s) can be operably connected to various sensors, actuators, electrical systems, etc. such that the information and data required to perform the flow process described herein can be provided thereto. Further, the controller(s) can include processors, memory, and other components as will be appreciated by those of skill in the art. The flow process 300 can be used with refrigeration systems as described above and/or variations thereon.

At block 302, the refrigeration system initiates a compressor shutdown operation. The compressor shutdown operation can be initiated by the controller when the controller detects one or more of various predetermined conditions that require a compressor shutdown. For example, compressor shutdown may be initiated based on internal temperatures of a container box or a defrost operation is to be performed.

At block 304, the controller records shutdown conditions of the refrigeration system and container at the time the shutdown operation is initiated. The shutdown conditions can include, but are not limited to, return air temperature to the evaporator, supply air temperature to the container, and ambient air temperature. As will be appreciated by those of skill in the art, the return air temperature to the evaporator is the most accurate indication of the air temperature of the container that is being cooling by the refrigeration system (e.g., the air that is pulled into the refrigeration unit from the container during a cooling operation). The supply air temperature to the container is the temperature of the air that is supplied from the refrigeration unit into the container to be cooled. The ambient air temperature is the air temperature external to the container (e.g., air that is pulled into the refrigeration system for heat exchange or mixing with return air).

At block 306, the controller calculates restart characteristics based on the recorded shutdown conditions. That is, the controller takes the shutdown condition information and measurements to determine or predict the characteristics that will occur at the next restart operation (e.g., the restart that occurs after the current shutdown that was initiated). The restart characteristics can include, but is not limited to, a static pressure ratio and a predicted static saturated evaporator/suction temperature.

The static pressure ratio is a function of ambient air temperature and return air temperature to the evaporator. The static pressure ratio is a predicted pressure ratio the refrigeration system will be at the next restart condition. The predicted saturated evaporator/suction temperature is based on the return air temperature at the evaporator. The predicted static saturated evaporator/suction temperature is an indication of what the evaporator and/or suction pressure could be at the next restart condition based on the return air temperature at the time of shutdown. As will be appreciated by those of skill in the art, there may be very little change in the internal temperature within a container from a typical compressor shutdown event to a restart event. Accordingly, the saturation temperature and density of the refrigerant mixture in the evaporator coils will not exceed the temperature within the container.

At block 308, the controller will compare the calculated restart characteristics (obtained at block 306) with one or more compressor restart safety limits. The compressor restart safety limits may be predefined or selected based on the specific refrigeration system being used, based on cargo to be cooled within the container, based on expected ambient conditions (e.g., transport and/or storage of the container such that weather or other variables may be considered). The restart safety limits are predefined to ensure that restart of the compressor is not attempted at conditions that may damage the compressor or impart unnecessary loads or stresses on the system. The restart safety limits are readily appreciated by those of skill in the art and can depend on compressor configurations, box conditions, product or cargo conditions and/or requirements, air temperatures, air densities, ambient or environmental (e.g., exterior) conditions, etc.

For example, in some configurations the comparison performed at block 308 may be a check if the calculated static pressure ratio at block 306 is less than a predetermined static pressure ratio limit. In other configurations, a check may be made wither the calculated static saturated evaporator/suction temperature is greater than a predetermined saturated evaporator/suction temperature limit. Further, in some embodiments, both above described checks/comparisons may be performed. Other types of restart safety limits may be preset or predetermined and compared at block 308, as known in the art, and the above described comparisons are provided for example only.

Based on the comparison at block 308, the controller makes a decision to perform one of various actions. The comparison is made to ensure that the next restart operation will not unduly burden, damage, or otherwise negatively impact the compressor at restart.

For example, if the controller determines that one or more of the calculated restart characteristics fails to satisfy the compressor restart safety limit(s), the controller may perform the operation of block 310. The failure indication of a specific calculated restart characteristic may be dependent upon the particular safety limit condition. For example, if the safety limit is a lower limit or threshold, then failure, wear, fatigue, or damage may be a result of the particular calculated characteristic being above the limit or threshold. Similarly, if the safety limit is an upper limit or threshold, then failure, wear, fatigue, or damage may be a result of the particular calculated characteristic being below the upper limit or threshold.

If failure to satisfy the safety limit(s) is determined at block 308, the flow process continues to block 310. At block 310, the controller controls an electronic valve assembly, such as an electronic expansion valve or suction modulation valve, to close and temperature modulation control is performed with the compressor in an energized state. That is, if the appropriate conditions are not met, the compressor is not shutdown, but rather, further temperature control is performed. That is, the system is configured to continue to modulate the compressor until desired or appropriate conditions are met. Such modulation can include compressor on/off cycling and/or throttling of the compressor.

The temperature modulation can include proactively closing the evaporator control valve (e.g., electronic expansion valve, suction modulation valve, etc.), running the compressor, monitoring evaporator pressure, and driving the evaporator pressure down to a desired level. By proactively closing the evaporator control valve, the refrigerant can be drained through a pump down operation and/or a suction operation. Accordingly, a mini-pump down operation can be performed to pre-condition the pressure within the refrigeration system in anticipation of the next restart operation.

After the temperature modulation is performed at block 310, the flow process returns to block 304, where new shutdown conditions are recorded. That is, the temperature modulation operation will change one or more of the shutdown condition parameters (e.g., return air temperature to the evaporator, supply air temperature to the container, and ambient air temperature). The flow process then repeats with a re-calculation of restart characteristics based on the newly achieved shutdown conditions (block 306), and a comparison is then performed again (block 308). Such process may be repeated until the calculated restart characteristic(s) are within the restart safety limit(s).

When the controller determines that the calculated restart characteristics are within the restart safety limits (at block 308), the flow process will continue to block 312. At block 312, the compressor shutdown operation will be completed, and the compressor will be turned off. During the compressor shutdown operation the evaporator control valve will be closed, either at block 310 or block 312, depending on the conditions that the time the flow process 300 begins.

Advantageously, embodiments described herein provide refrigeration system with improved reliability and product life. For example, embodiments provided herein provide a controlled compressor restart with optimal re-starting conditions such that on/off cycles may result relatively low impact on a scroll type compressor of the refrigeration system. For example, fluid density can reduce scroll type compressor damage and/or failures. Further, advantageously, embodiments provided herein can reduce the number of high motion profile restarts associated as employed by refrigeration units that incorporate compressors as described herein.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

For example, although only one simple configuration of a refrigeration system is shown and described, those of skill in the art will appreciate that other components and/or features may be added to the system without departing from the scope of the disclosure. Further, configurations of the components may be used without departing from the scope of the disclosure. Moreover, although described in a specific order of steps and/or timeliness, those of skill in the art will appreciate that these are merely examples, and the process may be varied depending on the needs and configurations that employ the process.

Accordingly, the present disclosure is not to be seen as limited by the foregoing description, but is only limited by the scope of the appended claims.

What is claimed is:

1. A method of operating a refrigeration system comprising:

initiating a compressor shutdown operation;

recording shutdown conditions at a time when the compressor shutdown operation is initiated, wherein the shutdown conditions include at least one of return air temperature to an evaporator of the refrigeration system, supply air temperature to a volume cooled by the refrigeration system, or ambient air temperature;

calculating one or more restart characteristics based on the recorded shutdown conditions, wherein the one or more calculated restart characteristics includes at least one of a static pressure ratio or a predicted static saturated evaporator/suction temperature, wherein at least one of (i) the static pressure ratio is a function of ambient air temperature and return air temperature to the evaporator of the refrigeration system and (ii) the predicted static saturated evaporator/suction temperature is based on a return air temperature at the evaporator of the refrigeration system;

comparing the calculated restart characteristics with one or more compressor restart safety limits, wherein the restart safety limits are at least one of a predetermined static pressure ratio limit or a predetermined static saturated evaporator/suction temperature limit, and the comparison comprises at least one of determining if the calculated static pressure ratio is less than the predetermined static pressure ratio limit or determining if the predicted static saturated evaporator/suction temperature is less than the predetermined static saturated evaporator/suction temperature limit;

when the calculated restart characteristics do not satisfy the restart safety limits, controlling an electronic valve assembly to close while the compressor is running and performing a temperature modulation pump down operation to reduce a refrigerant density; and when the calculated restart characteristics satisfy the restart safety limits, completing the compressor shutdown operation.

2. The method of claim 1, wherein the one or more calculated restart characteristics is the calculated static pressure ratio.

3. The method of claim 1, wherein the one or more calculated restart characteristics is the predicted static saturated evaporator/suction temperature.

4. The method of claim 1, wherein the temperature modulation pump down operation comprises closing an evaporator control valve.

5. The method of claim 1, further comprising repeating the recording, calculating, and comparing after performing the temperature modulation pump down operation.

6. A refrigeration system comprising:

a compressor;

an evaporator;

a fluid path fluidly connecting the compressor and the evaporator;

an evaporator control valve operably connected to the fluid path to control fluid flow to or form the evaporator; and a controller configured to:

initiate a compressor shutdown operation;

record shutdown conditions at a time when the compressor shutdown operation is initiated, wherein the shutdown conditions include at least one of return air temperature to an evaporator of the refrigeration system, supply air temperature to a volume cooled by the refrigeration system, or ambient air temperature;

calculate one or more restart characteristics based on the recorded shutdown conditions, wherein the one or more calculated restart characteristics includes at least one of a static pressure ratio or a predicted static saturated evaporator/suction temperature, wherein the one or more calculated restart characteristics includes at least one of a static pressure ratio or a predicted static saturated evaporator/suction temperature, wherein at least one of (i) the static pressure ratio is a function of ambient air temperature and return air temperature to the evaporator of the refrigeration system and (ii) the predicted static saturated evaporator/suction temperature is based on a return air temperature at the evaporator of the refrigeration system;

compare the calculated restart characteristics with one or more compressor restart safety limits, wherein the restart safety limits are at least one of a predetermined static pressure ratio limit or a predetermined static saturated evaporator/suction temperature limit, and the comparison comprises at least one of determining if the calculated static pressure ratio is less than the predetermined static pressure ratio limit or determining if the predicted static saturated evaporator/suction temperature is less than the predetermined static saturated evaporator/suction temperature limit;

when the calculated restart characteristics do not satisfy the restart safety limits, control the refrigeration system to close an electronic valve assembly while the compressor is running and perform a temperature modulation pump down operation to reduce a refrigerant density; and when the calculated restart characteristics satisfy the restart safety limits, control the compressor to complete the shutdown operation.

7. The system of claim 6, wherein the one or more calculated restart characteristics is the calculated static pressure ratio.

8. The system of claim 6, wherein the one or more calculated restart characteristics is the predicted static saturated evaporator/suction temperature.

9. The system of claim 6, wherein the temperature modulation pump down operation comprises closing an evaporator control valve.

10. The system of claim 6, wherein the compressor is a scroll type compressor.

11. The system of claim 6, wherein the temperature modulation pump down operation comprises running a compressor of the refrigeration system in an energized state.

12. The system of claim 6, wherein the temperature modulation pump down operation comprises performing a pump down operation.

13. The system of claim 6, wherein the temperature modulation pump down operation comprises performing a suction operation.

14. The method of claim 1, wherein the temperature modulation pump down operation comprises running a compressor of the refrigeration system in an energized state.

15. The method of claim 1, wherein the temperature modulation pump down operation comprises performing a pump down operation.

16. The method of claim 1, wherein the temperature modulation pump down operation comprises performing a suction operation.

* * * * *